US007535437B2

(12) United States Patent
Kim et al.

(10) Patent No.: US 7,535,437 B2
(45) Date of Patent: May 19, 2009

(54) STRUCTURE AND DRIVING METHOD OF PLASMA DISPLAY PANEL

(75) Inventors: Jin Young Kim, Taegu-shi (KR); Seong Ho Kang, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 625 days.

(21) Appl. No.: 11/109,689

(22) Filed: Apr. 20, 2005

(65) Prior Publication Data

US 2005/0184930 A1 Aug. 25, 2005

Related U.S. Application Data

(63) Continuation of application No. 09/695,976, filed on Oct. 26, 2000, now Pat. No. 6,975,284.

(30) Foreign Application Priority Data

Oct. 28, 1999 (KR) ..... 1999-47167

(51) Int. Cl.
*G09G 3/28* (2006.01)

(52) U.S. Cl. ..... 345/60; 345/66

(58) Field of Classification Search ..... 345/60–68, 345/40–41; 313/582, 584, 586; 315/169.1, 315/169.3, 169.4
See application file for complete search history.

(56) References Cited

U.S. PATENT DOCUMENTS

| | | | | |
|---|---|---|---|---|
| 5,210,468 | A | 5/1993 | Yoshioka | |
| 5,212,472 | A | 5/1993 | Takahashi et al. | |
| 5,661,500 | A | 8/1997 | Shinoda et al. | |
| 5,835,072 | A | 11/1998 | Kanazawa | |
| 5,990,630 | A | 11/1999 | Nakamura | |
| 6,011,355 | A | 1/2000 | Nagai | |
| 6,034,482 | A | 3/2000 | Kanazawa et al. | |
| 6,118,214 | A | 9/2000 | Marcotte | |
| 6,124,849 | A | 9/2000 | Ito et al. | |
| 6,140,984 | A | 10/2000 | Kanazawa et al. | |
| 6,144,348 | A * | 11/2000 | Kanazawa et al. | 345/60 |
| 6,175,194 | B1 | 1/2001 | Saegusa et al. | |

(Continued)

FOREIGN PATENT DOCUMENTS

| | | |
|---|---|---|
| JP | 08-096714 | 4/1996 |

(Continued)

*Primary Examiner*—Nitin Patel
(74) *Attorney, Agent, or Firm*—KED & Associates, LLP

(57) ABSTRACT

A structure and driving method of a plasma display panel is provided, in which an amount of priming particles within a discharge cell increases to reduce discharge lag of address discharge. The structure of the plasma display panel includes a plurality of sustain electrode pairs successively formed on an upper electrode, a plurality of common electrodes formed one by one between a pair of the sustain electrodes, and a dielectric layer formed on the substrate to deposit the sustain electrodes and the common electrodes. The method for driving the plasma display panel includes the steps of applying a common pulse, which is periodically turned on/off, to the common electrodes, applying a scan pulse to one of a pair of the sustain electrodes, and applying an address pulse to the address electrodes when the scan pulse is applied to the one sustain electrode. Thus, since discharge conditions within the discharge cell can be improved, discharge lag less occurs than the related art plasma display panel.

39 Claims, 9 Drawing Sheets

U.S. PATENT DOCUMENTS

| | | | | |
|---|---|---|---|---|
| 6,195,072 | B1 | 2/2001 | Iwami et al. | |
| 6,236,165 | B1 | 5/2001 | Ishizuka | |
| 6,252,574 | B1 * | 6/2001 | Hosoi et al. | 345/103 |
| 6,369,781 | B2 | 4/2002 | Hashimoto et al. | |
| 6,373,452 | B1 | 4/2002 | Ishii et al. | |
| 6,426,732 | B1 | 7/2002 | Makino | |
| 6,428,377 | B1 | 8/2002 | Choi | |
| 6,433,471 | B1 | 8/2002 | Khan et al. | |
| 6,456,265 | B1 * | 9/2002 | Mikoshiba et al. | 345/66 |
| 6,483,251 | B2 | 11/2002 | Setoguchi et al. | |
| 6,597,334 | B1 | 7/2003 | Nakamura | |

FOREIGN PATENT DOCUMENTS

| | | |
|---|---|---|
| JP | 8096714 | 4/1996 |
| JP | 10222120 A | 2/1997 |
| JP | 09-245627 | 9/1997 |

* cited by examiner

STRUCTURE AND DRIVING METHOD OF PLASMA DISPLAY PANEL

This application is a continuation of U.S. application Ser. No. 09/695,976 filed Oct. 26, 2000, now U.S. Pat. No. 6,975,284. The disclosures of the previous application is incorporated by reference herein.

BACKGROUND OF THE INVENTION

1. Field of the Invention

The present invention relates to a plasma display panel, and more particularly to a structure and driving method of a plasma display panel.

2. Discussion of the Related Art

Generally, a plasma display panel has higher definition than a cathode ray tube (CRT), various sized screens, and a thin thickness. In this respect, the plasma display panel has lately attracted considerable attention as the most practical next generation display of flat panel displays. Also, since the plasma display panel has a weight of ⅓ of a CRT having the same sized screen, a large sized panel of 40 inch to 60 inch can thinly be fabricated at a thickness of 10 cm or below.

The CRT and a liquid crystal display device are limited by their sizes when digital data and full motion are displayed at the same time. However, the plasma display panel does not have such a problem. Furthermore, the CRT may be affected by magnetic force. However, the plasma display panel is not susceptible to magnetic force, thereby providing stable images to viewers. Moreover, since each pixel of the plasma display panel is digitally controlled, image distortion of corners on a screen does not occur. Thus, the plasma display panel can provide higher picture quality than the CRT.

The plasma display panel includes two glass substrates coated with electrodes, and a gas sealed between the glass substrates. The electrodes formed in the glass substrates oppose each other in vertical direction, and pixels are formed in crossing portions of the electrodes.

A related art plasma display panel of three-electrode area discharge type will be described with reference to the accompanying drawings.

As shown in FIG. 1*a*, the related art plasma display panel of three-electrode area discharge type includes an upper substrate 10 and a lower substrate 20 which face each other. FIG. 1*b* shows a sectional structure of the plasma display panel shown in FIG. 2, in which the lower substrate 20 is rotated by 90°.

The upper substrate 10 includes scan electrodes 16 and 16', sustain electrodes 17 and 17', a dielectric layer 11, and a protection layer 12. The scan electrodes 16 and 16' are formed in parallel to the sustain electrodes 17 and 17'. The dielectric layer 11 is deposited on the scan electrodes 16 and 16' and the sustain electrodes 17 and 17'.

The lower substrate 20 includes an address electrode 22, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and of the dielectric film 21. Inert gases such as He and Xe are mixed in a space between the upper substrate 10 and the lower substrate 20 at a pressure of 400 to 600 Torr. The space forms a discharge area.

The scan electrodes 16 and 16' and the sustain electrodes 17 and 17' are of transparent electrodes and bus electrodes of metals so as to increase optical transitivity of each discharge cell, as shown in FIGS. 2*a* and 2*b*. That is to say, the electrodes 16 and 17 are of transparent electrodes while the electrodes 16' and 17' are of bus electrodes.

FIG. 2*a* is a plane view of the sustain electrodes 17 and 17' and the scan electrodes 16 and 16', and FIG. 2*b* is a sectional view of the sustain electrodes 17 and 17' and the scan electrodes 16 and 16'.

A discharge voltage from an externally provided driving integrated circuit (IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 μm and are made of indium oxide or tin oxide. The bus electrodes 16' and 17' are formed of a three-layered thin film of Cr—Cu—Cr. At this time, the bus electrodes 16' and 17' have a line width of ⅓ of a line width of the transparent electrodes 16 and 17.

FIG. 3 is a wiring diagram of scan electrodes ($S_{m-1}$, $S_m$, $S_{m+1}$, $S_{n-1}$, $S_n$, $S_{n+1}$) and sustain electrodes ($C_{m-1}$, $C_m$, $C_{m+1}$, . . . , $C_{n-1}$, $C_n$, $C_{n+1}$) arranged on the upper substrate. In FIG. 3, the scan electrodes are insulated from one another while the sustain electrodes are connected in parallel. Particularly, a block indicated by a dotted line in FIG. 3 shows an active area where an image is displayed and the other blocks show inactive areas where an image is not displayed. The scan electrodes arranged in the inactive areas are generally called dummy electrodes 26. The number of the dummy electrodes 26 are not specially limited.

The operation of the aforementioned AC type plasma display panel of three-electrode area discharge type will be described with reference to FIGS. 4*a* to 4*d*.

If a driving voltage is applied between the address electrodes and the scan electrodes, opposite discharge occurs between the address electrodes and the scan electrodes as shown in FIG. 4*a*. The inert gas injected into the discharge cell is instantaneously excited by the opposite discharge. If the inert gas is again transited to the ground state, ions are generated. The generated ions or some electrons of quasi-excited state come into collision with a surface of the protection layer as shown in FIG. 4*b*. The collision of the electrons secondarily discharges electrons from the surface of the protection layer. The secondarily discharged electrons come into collision with a plasma gas to diffuse the discharge. If the opposite discharge between the address electrodes and the scan electrodes ends, wall charges having opposite polarities occur on the surface of the protection layer on the respective address electrodes and the scan electrodes, as shown in FIG. 4*c*.

If the discharge voltages having opposite polarities are continuously applied to the scan electrodes and the sustain electrodes and at the same time the driving voltage applied to the address electrodes is cut off, area discharge occurs in a discharge area on the surfaces of the dielectric layer and the protection layer due to potential difference between the scan electrodes and the sustain electrodes as shown in FIG. 4*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrodes and the isolation wall so that the phosphors are excited. The excited phosphors generate visible light rays, and the visible light rays display an image on a screen.

One pixel includes a discharge cell having a red phosphor, a discharge cell having a green phosphor, and a discharge cell having a blue phosphor. Contrast of an image displayed in the plasma display panel is controlled by the number of times of discharge in each discharge cell.

In the plasma display panel, priming effect is used to generate discharge in each discharge cell. In this case, priming particles, such as free electrons, ions, and quasi-stable atoms, are required. If electric field is sufficiently applied to the electrons, movement of the electrons is accelerated. When the electrons accelerated at a constant speed or greater come into collision with gas atoms or quasi-stable gas atoms, the gas atoms or the quasi-stable gas atoms can be ionized. Then, there are separated electrons and ions. The separated electrons are accelerated again by the electric field.

The sufficiently accelerated electrons come into collision with other gas atoms. In this case, another ionization may occur.

The ions are accelerated in opposition direction to the electrons. When the ions come into collision with a protection layer of MgO at a cathode, secondary electrons are discharged. The secondary electrons are accelerated by the electric field and come into collision with other gas atoms. In this case, the number of the electrically separated electrons gradually increases. If the number of the secondary electrons generated by collision of ions with the protection layer increases, the number of the gas atoms to be ionized increases. As a result, flow of the electrons or ions rapidly increases. This is called discharge.

At this time, it takes about several hundreds of ns or several Us to reach discharge after applying the electric field. This is called a discharge lag. The discharge lag includes a statistic time lag and a formative time lag. The formative time lag is caused by some factors such as kinds and pressure of gas, a structure of a cell, and discharge coefficient of the secondary electrons of the protection layer. The discharge lag is concerned in a width of a pulse for driving of the plasma display panel.

The formative time lag is generally within the range of several hundreds of ns while the statistic time lag is within the range of several hundreds of ns to several μs. If the priming particles exist at a sufficient concentration, the statistic time lag is set within several hundreds of ns. However, if the priming particles do not exist at a sufficient concentration, delay may occur for 3 μs to 4 μs. The most priming particles exist directly after discharge. The number of the priming particles is reduced as they are diffused to the discharge space, recombined, excited, and transited to the ground state.

The concentration of the priming particles from the time when discharge occurs to 30 μs does not affect the statistic time lag of the next discharge. However, the concentration of the priming particles after 30 μs has elapsed affects the statistic time lag of the next discharge.

For address discharge, if pulses are applied to the scan electrodes and the address electrodes, the discharge is completed within a desired time (generally, 3 μs) where the priming particles exist sufficiently. Thus, wall charges occur sufficiently. However, in the related art plasma display panel, it is likely that the priming particles do not exist sufficiently and thus the discharge is not completed within a desired time. In this case, address discharge may not occur in the discharge cell. This is called addressing failure or mis writing.

As described above, the related art plasma display panel has several problems.

Discharge lag is not constant due to deficiency of the priming particles for use in the priming effect. This could lead to address failure. Accordingly, to sufficiently generate wall charges, it is necessary to widen the width of the scan pulse applied to the scan electrodes at a constant level or greater. In this case, a problem arises in that a sustain time period is reduced if resolution becomes higher.

SUMMARY OF THE INVENTION

Accordingly, the present invention is directed to a structure and driving method of a plasma display panel that substantially obviates one or more of the problems due to limitations and disadvantages of the related art.

An object of the present invention is to provide a structure and driving method of a plasma display panel in which an amount of priming particles within a discharge cell increases to reduce discharge lag of address discharge, thereby reducing a width of an address pulse and fabricating a plasma display panel of high resolution.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes a plurality of sustain electrode pairs successively formed on an upper electrode, a plurality of common electrodes formed one by one between a pair of the sustain electrodes, and a dielectric layer formed on the substrate to deposit the sustain electrodes and the common electrodes.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

Figure 1A:
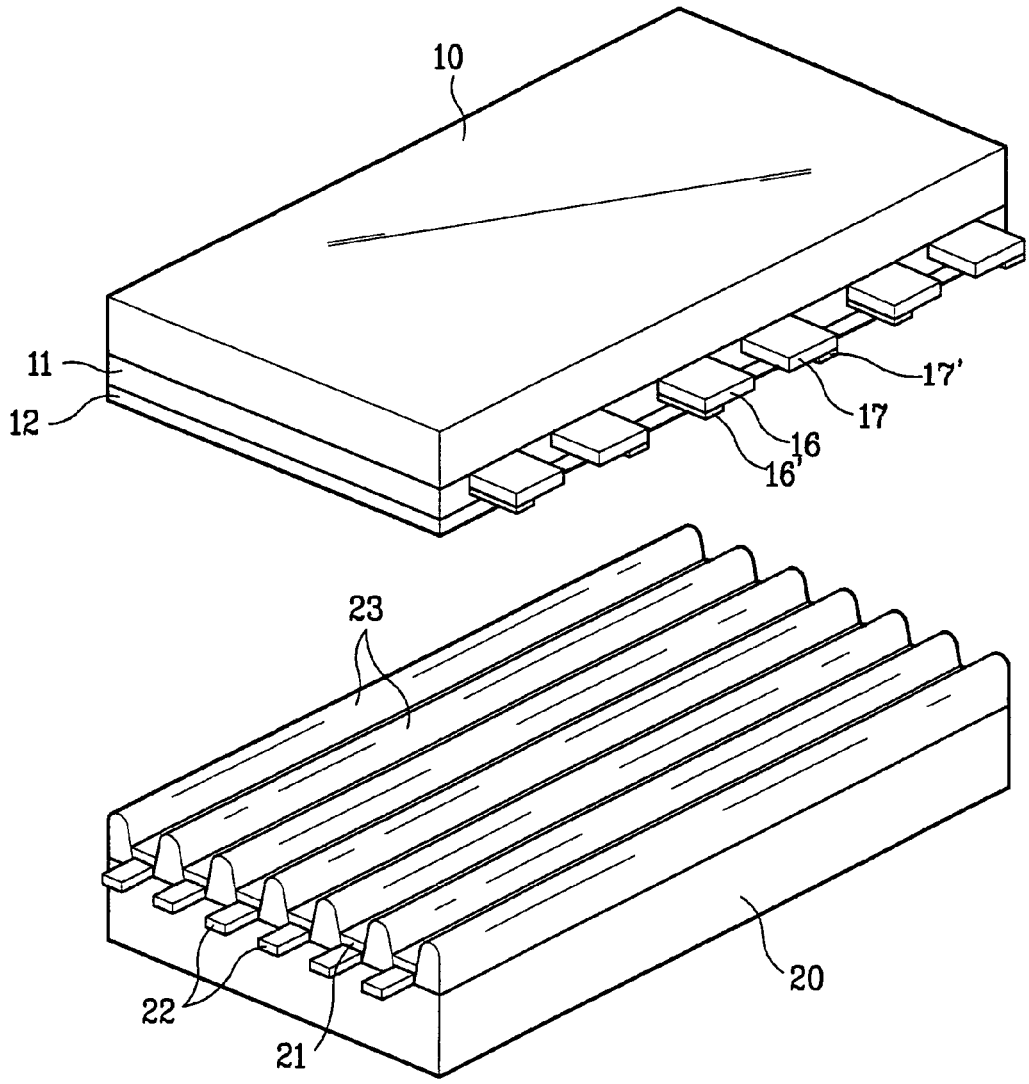
RELATED ART FIG.1A
FIGS. 1*a* and 1*b* are a sectional view and a plane view showing a structure of a general plasma display panel.
Figure 1B:
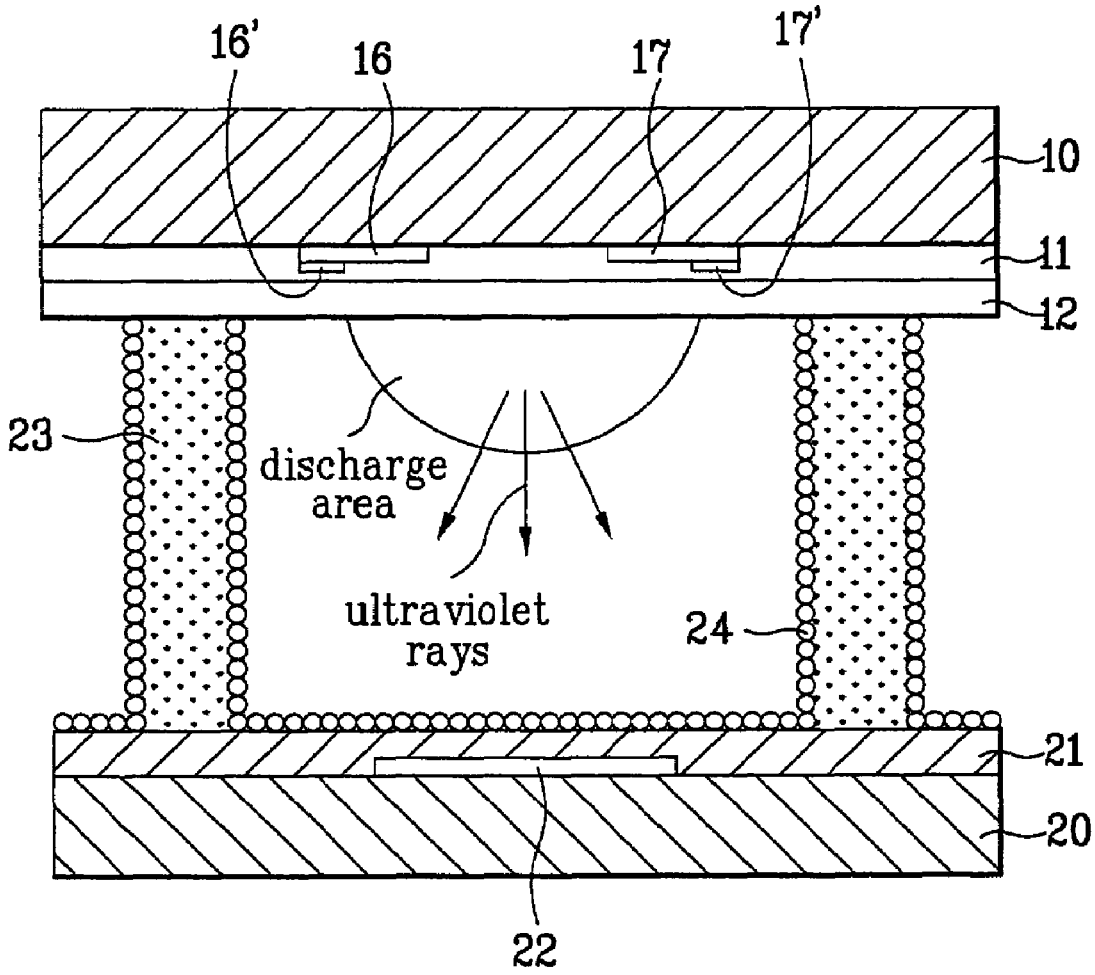
RELATED ART FIG.1B
Figure 2A:
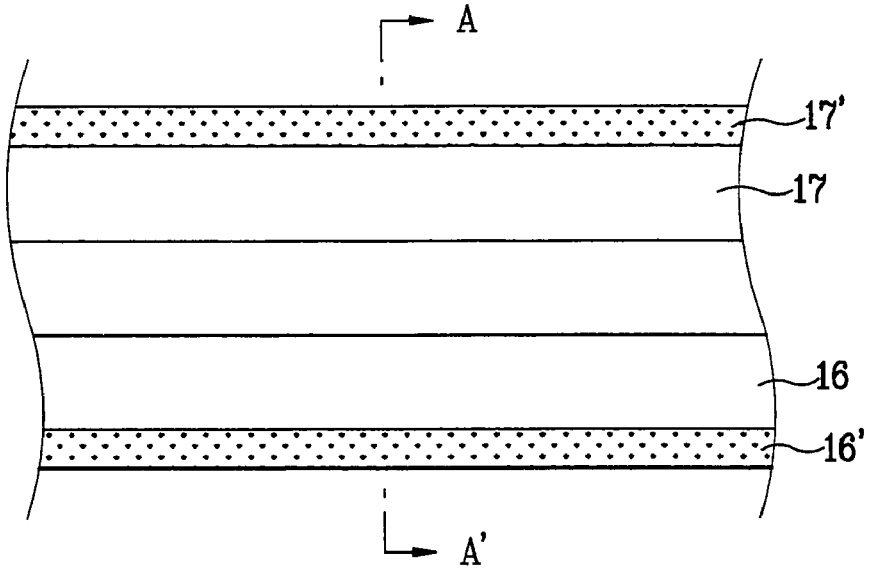
RELATED ART FIG.2A
FIGS. 2*a* and 2*b* are plane views showing scan electrodes and sustain electrodes of the plasma display panel.
Figure 2B:
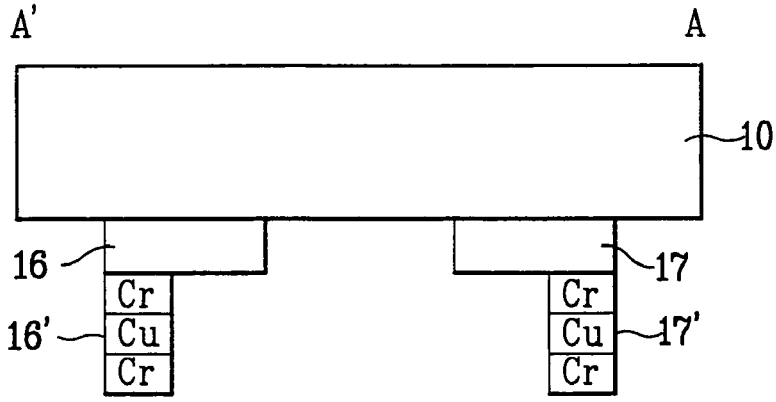
RELATED ART FIG.2B
Figure 3:
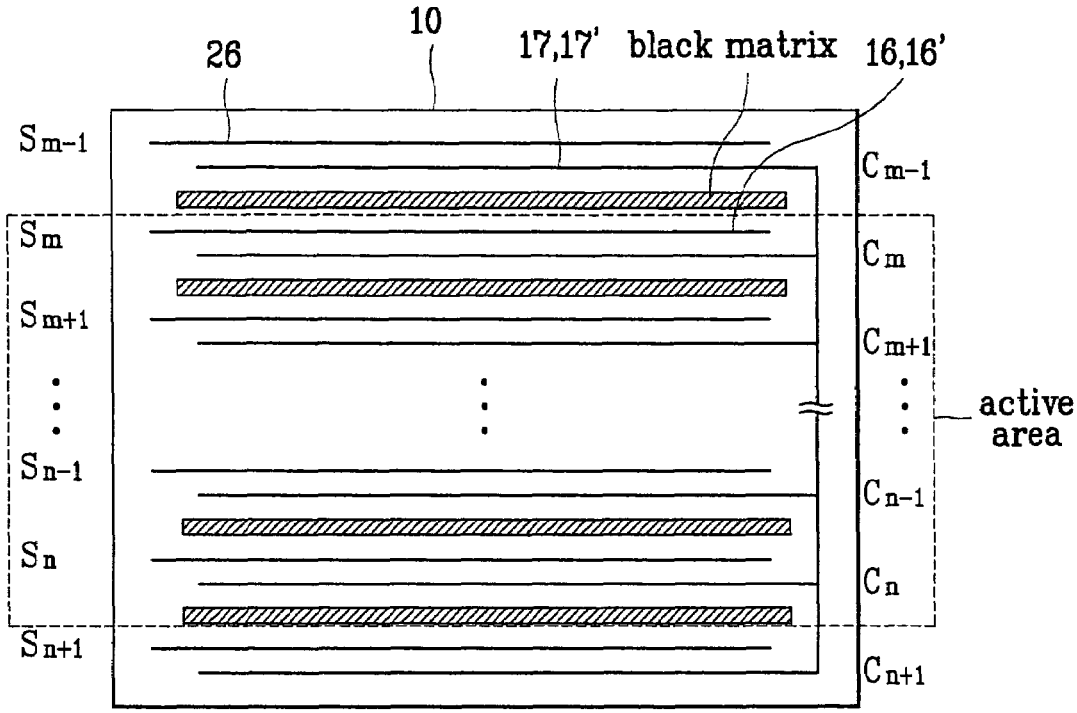
RELATED ART FIG.3
FIG. 3 is a plane view showing wiring of the scan electrodes and sustain electrodes of the plasma display panel.
Figure 4A:
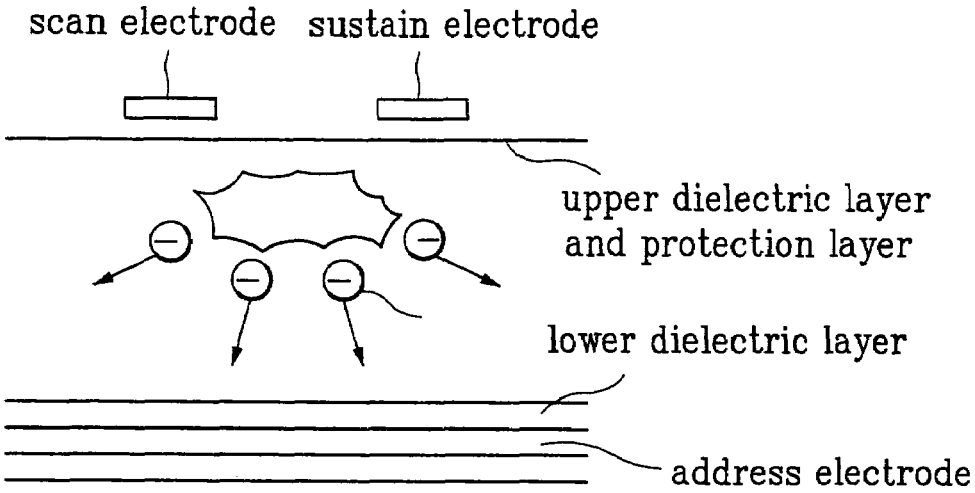
RELATED ART FIG. 4A
FIGS. 4*a* to 4*d* are sectional views showing discharge principles of the plasma display panel.
Figure 4B:
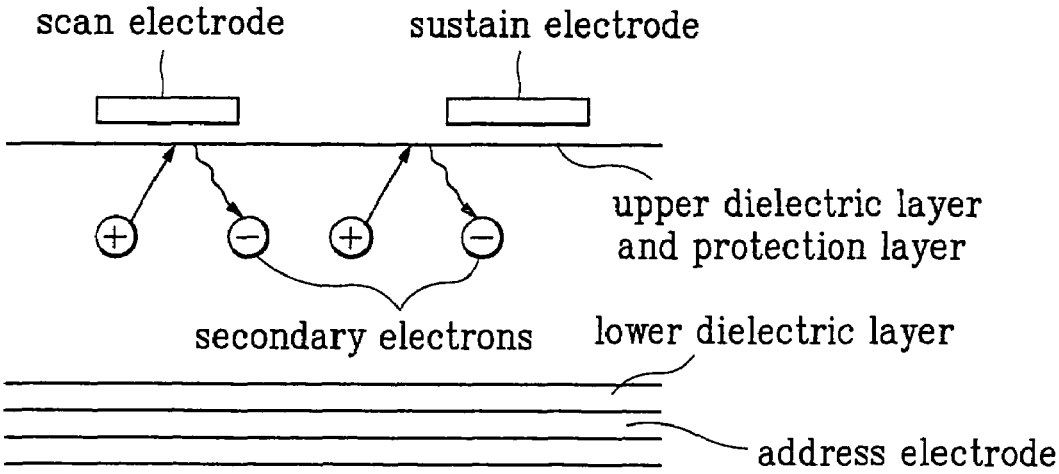
FIG. 4B RELATED ART
Figure 4C:
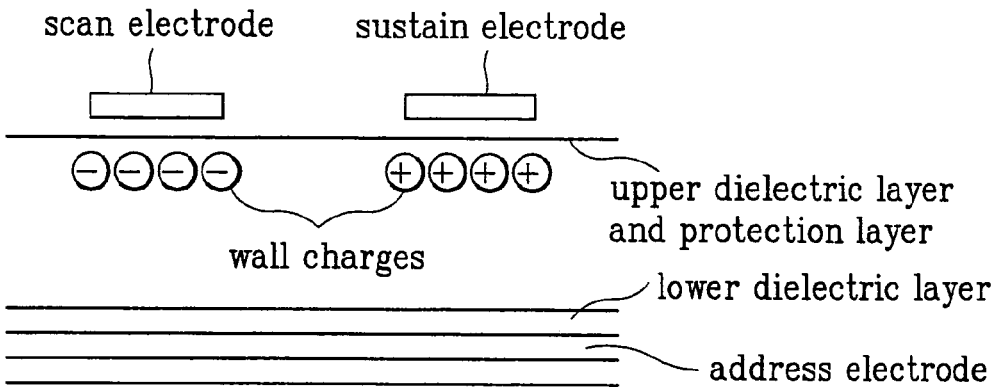
RELATED ART FIG. 4C
Figure 4D:
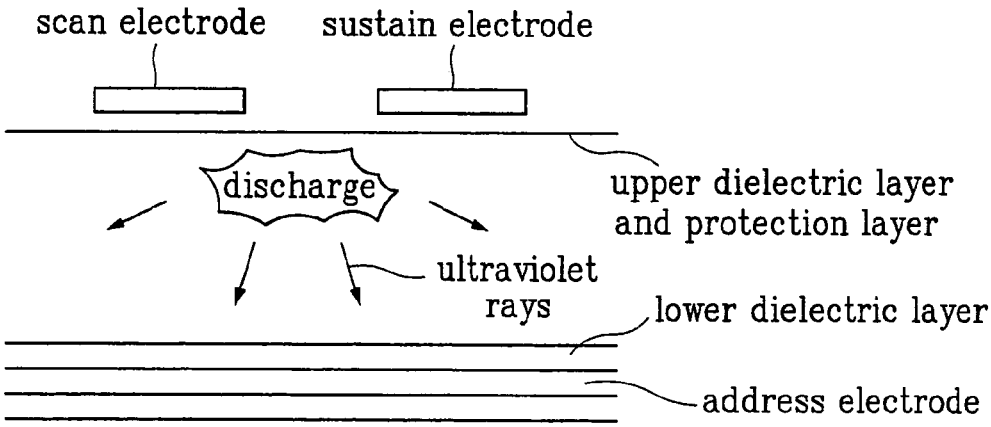
FIG. 4D RELATED ART
Figure 5:
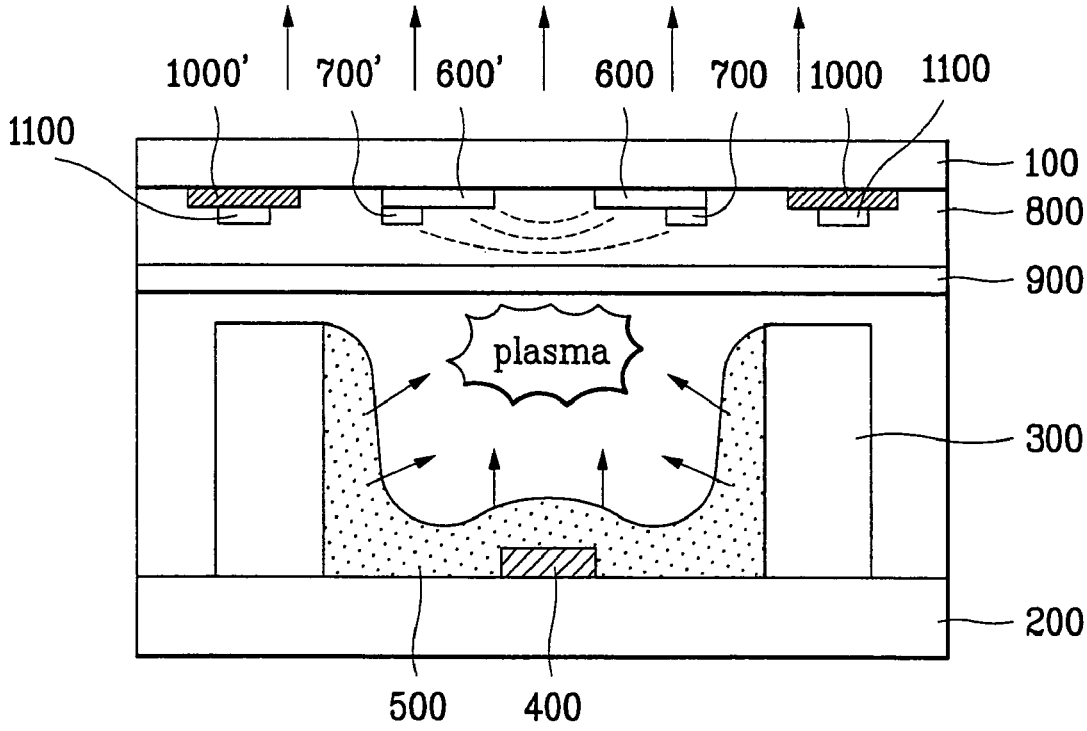
FIG. 5 is a sectional view showing a plasma display panel according to the present invention.

As shown in FIG. 5, a plasma display panel of the present invention includes a plurality of sustain electrodes, and a plurality of common electrodes formed between the respective sustain electrodes. A dielectric layer 800 is formed on an entire surface of an upper substrate 100 to deposit the sustain electrodes and the common electrodes 1100 and 1100'. The dielectric layer 800 is deposited within the range of 10 μs to 45 μs. A protection layer 900 of MgO is formed on the dielectric layer 800.

Figure 6A:
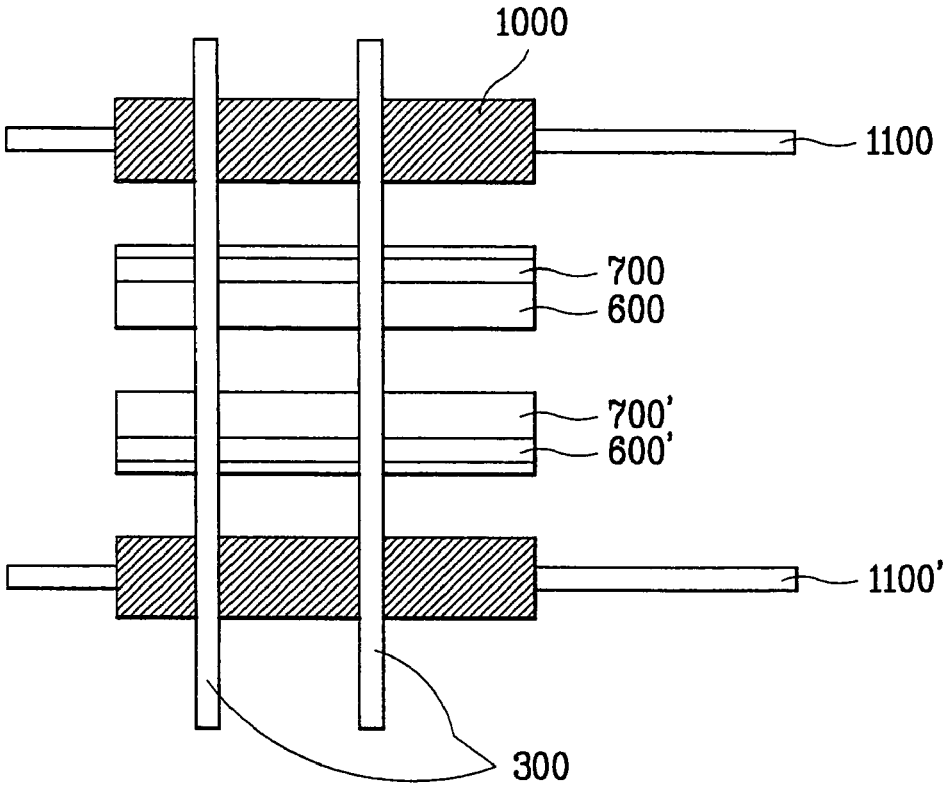
FIGS. 6*a* and 6*b* are plane views showing a structure of electrodes and their connection state of the plasma display panel according to the present invention.

As shown in FIG. 6*a*, the sustain electrodes include sustain electrodes 600 and 700 to which sustain discharge voltages are applied, and scan electrodes 600' and 700' to which the sustain discharge voltages and scan pulses are applied. The sustain electrodes 600 and 700 and the scan electrodes 600' and 700' are formed of discharge electrodes 600 and 600' of transparent electrodes and bus electrodes 700 and 700' of metal electrodes. A driving voltage is applied from an external driving circuit (not shown) to the sustain electrodes 600 and 700 and the scan electrodes 600' and 700' through the bus electrode having low resistance. At this time, voltage difference occurs between discharge electrodes of a pair of different sustain electrodes adjacent to each other due to the driving voltage applied through the bus electrode. The voltage difference causes plasma discharge within the discharge cell.

Common electrodes 1100 and 1100' are formed one by one between a pair of the sustain electrodes. That is, the respective common electrodes 1100 and 1100' are formed to divide the sustain electrodes in pairs. Each of the common electrodes 1100 and 1100' is formed of a three-layered metal thin film of Cr, Cu, and Cr sequentially deposited on the upper substrate 100. Alternatively, each of the common electrodes 1100 and 1100' may be formed of a single layer of Ag. Address electrodes 300 are formed to cross the sustain electrodes and the common electrodes.

Figure 6B:
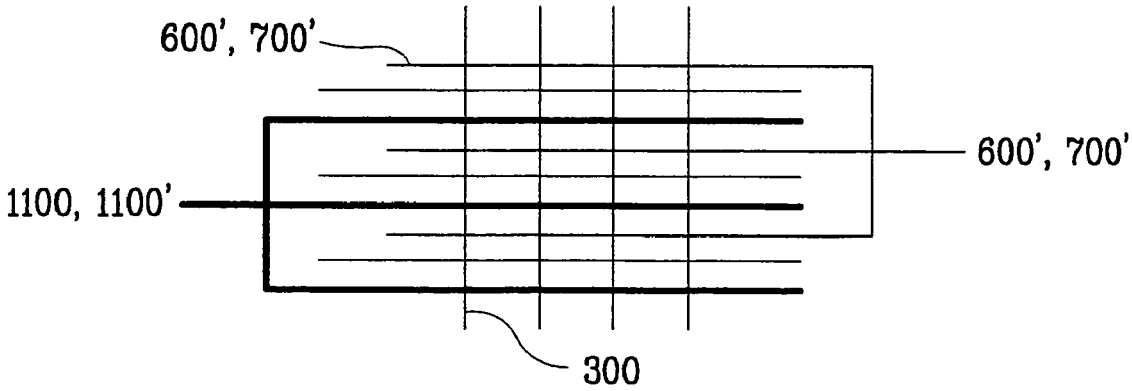

At this time, as shown in FIG. 6*b*, the common electrodes 1100 and 1100' are commonly connected to a common node in an outer region of the upper substrate 100. The same common pulse is applied to the common electrodes 1100 and 1100' through the external driving circuit.

Weak discharge may occur due to the common electrodes. To prevent picture quality of the plasma display panel from being affected by the weak discharge, black matrixes 1000 and 1000' may be formed between the upper substrate 100 and the common electrodes 1000 and 1000'. The black matrixes 1000 and 1000' may be formed on a rear surface of the upper substrate 100 on which the electrodes are formed.

The operation of the plasma display panel according to the present invention will be described below.

Figure 7:
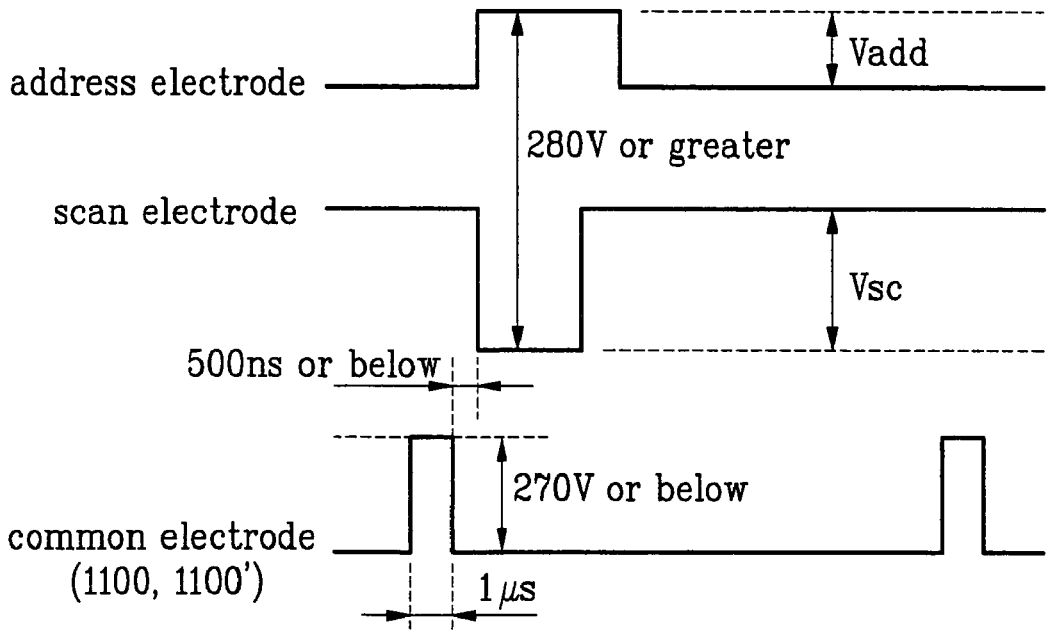
FIG. 7 is a waveform showing a voltage pulse applied to the plasma display panel according to the present invention.

FIG. 7 is a waveform showing a voltage pulse applied to the common electrodes 1100 and 1100' and the sustain electrodes of the plasma display panel according to the present invention.

A common pulse which periodically repeats high level and low level is applied to the common electrodes 1100 and 1100'. The high level potential of the common pulse is lower than a discharge start voltage of the plasma display panel. Preferably, the high level potential of the common pulse is about 270V or below. Also, the width of the common pulse, particularly, a high level section in one period is preferably set within the range of 1 μs or below.

After the high level section of the common pulse ends, a scan pulse is applied to the scan electrode of a pair of the sustain electrodes with some delay time. At the same time, an address pulse is applied to the address electrode when the scan pulse is applied to the scan electrode. At this time, the maximum potential difference between the scan pulse and the address pulse is greater than the discharge start voltage of the plasma display panel. Preferably, the maximum potential difference is set at about 280V or greater.

Furthermore, the delay time is preferably 500 ns or below. Namely, the time difference between the time when the high level of the common pulse is turned off and the time when the scan pulse is turned on, or the time difference between the time when the high level of the common pulse is turned off and the time when the address pulse is turned on is set at 500 ns or below.

At this time, the on-state of the scan pulse may be high level or low level. That is, the scan pulse or the address pulse is preferably set to have the maximum potential difference between them during on period regardless of their level state.

The discharge principles of the plasma display panel operated as above will now be described.

If the common pulse is applied to the common electrodes 1100 and 1100', discharge does not occur within the discharge cell but strong electric field is formed by a voltage of the common pulse. The strong electric field forms priming particles within the discharge cell so as to improve discharge conditions within the discharge cell.

Afterwards, the address pulse and the scan pulse are applied to the respective electrodes with a predetermined delay time so that address discharge occurs within the discharge cell. At this time, the delay time is preferably set within the range that the priming particles generated by the common pulse are not erased. The delay time is preferably set at about 500 ns.

As aforementioned, the plasma display panel according to the present invention has the following advantages.

Since the discharge conditions within the discharge cell can be improved by the common pulse, discharge lag less occurs than the related art plasma display panel. Accordingly, the width of the sustain pulse for sustain discharge is more reduced than the related art. This could lead to fabrication of a plasma display panel having higher resolution than the related art. Moreover, since the sustain period which sustains light-emission during driving operation can be increased, higher luminance can be achieved.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus comprising a discharge cell, sustain electrodes, address electrons, scan electrodes and means of forming priming particles in the discharge cell to reduce discharge lag, wherein the means of forming priming particles includes electrodes separate from the sustain electrodes, the address electrodes and the scan electrodes, and wherein the means of forming priming particles receives a pulse separate from an address pulse and a scan pulse, and the pulse has a width of approximately 1 microsecond or less.

2. The apparatus of claim 1, wherein the pulse is of a voltage insufficient to cause discharge within the discharge cell.

3. The apparatus of claim 1, wherein the apparatus comprises an AC-type plasma display panel.

4. A plasma display panel comprising:

a first electrode configured to increase the amount of priming particles in a discharge cell to reduce discharge lag in response to an electrical pulse applied to the first electrode;

a second electrode and a third electrode; and the second electrode and the third electrode are configured to form wall charges proximate to the second electrode and the third electrode in response to a first voltage applied to the second electrode and a second voltage applied to the third electrode.

5. The plasma display panel of claim 4, wherein the second electrode is a scan electrode.

6. The plasma display panel of claim 4, wherein the third electrode is an address electrode.

7. The plasma display panel of claim 4, wherein the first voltage and the second voltage have opposite polarities.

8. The plasma display panel of claim 4, wherein a potential difference between the first voltage and the second voltage is greater than the magnitude of the electrical pulse applied to the first electrode.

9. The plasma display panel of claim 4, wherein the magnitude of the electrical pulse applied to the first electrode is less than or equal to 270 Volts.

10. The plasma display panel of claim 4, wherein the potential difference between the first voltage and the second voltage is greater than or equal to 180 Volts.

11. The plasma display panel of claim 4, wherein the first voltage is a negative voltage and the second voltage is a positive voltage.

12. The plasma display panel of claim 4, wherein the delay between the end of the electrical pulse and the start of the application of either the first voltage or the second voltage is approximately 500 nanoseconds.

13. The plasma display panel of claim 4, wherein the delay between the end of the electrical pulse and the start of the application of either the first voltage or the second voltage is less than 500 nanoseconds.

14. The plasma display panel of claim 4, wherein the start of the application of the first voltage and the start of the application of the second voltage occur at approximately the same time.

15. A plasma display panel comprising a first electrode configured to increase the amount of priming particles in a discharge cell to reduce discharge lag in response to an electrical pulse applied to the first electrode, wherein priming particles comprise at least one of free electrons, ions, and quasi-stable atoms, and wherein the electrical pulse is approximately 1 microsecond or less.

16. A method comprising priming particles in a discharge cell in response to an electrical pulse applied to a first electrode to reduce discharge lag, wherein priming particles comprise at least one of free electrons, ions, and quasi-stable atoms, and wherein the electrical pulse is approximately 1 microsecond or less.

17. A method comprising priming particles in a discharge cell in response to an electrical pulse applied to a first electrode to reduce discharge lag, forming, in the discharge cell, wall charges proximate to a second electrode and a third electrode in response to a first voltage applied to the second electrode and a second voltage applied to the third electrode.

18. The method of claim 17, wherein the second electrode is a scan electrode.

19. The method of claim 17, wherein the third electrode is an address electrode.

20. The method of claim 17, wherein the first voltage and the second voltage have opposite polarities.

21. The method of claim 17, wherein a potential difference between the first voltage and the second voltage is greater than the magnitude of the electrical pulse applied to the first electrode.

22. The method of claim 17, wherein the magnitude of the electrical pulse applied to the first electrode is less than or equal to 270 Volts.

23. The method of claim 17, wherein the potential difference between the first voltage and the second voltage is greater than or equal to 180 Volts.

24. The method of claim 17, wherein the first voltage is a negative voltage and the second voltage is a positive voltage.

25. The method of claim 17, wherein the delay between the end of the electrical pulse and the start of the application of either the first voltage or the second voltage is approximately 500 nanoseconds.

26. The method of claim 17, wherein the delay between the end of the electrical pulse and the start of the application of either the first voltage or the second voltage is less than 500 nanoseconds.

27. The method of claim 17, wherein the start of the application of the first voltage and the start of the application of the second voltage occur at approximately the same time.

28. A plasma display panel comprising:

a first substrate and a second substrate;

a plurality of barrier ribs on the second substrate, the plurality of barrier ribs including a first barrier rib, a second barrier rib and a third barrier rib to define a plurality of discharge cells;

a first scan electrode and a first sustain electrode on the first substrate at an area corresponding to a first discharge cell;

a second scan electrode and a second sustain electrode on the first substrate at an area corresponding to a second discharge cell adjacent to the first discharge cell;

an address electrode on the second substrate;

a first additional electrode on the first substrate at an area between the first discharge cell and the second discharge cell; and a dielectric layer on the first substrate.

29. The plasma display panel of claim 28, wherein the first discharge cell is provided between the first barrier rib and the second barrier rib, and the second discharge cell is provided between the second barrier rib and the third barrier rib.

30. The plasma display panel of claim 29, wherein the first additional electrode is provided over the second barrier rib.

31. The plasma display panel of claim 28, wherein the first scan electrode and the address electrode are configured to form wall charges proximate to the first scan electrode and the address electrode.

32. The plasma display panel of claim 28, wherein the dielectric layer has a thickness of 10 μm to 45 μm.

33. The plasma display panel of claim 28, further comprising a black matrix between the first additional electrode and the first substrate.

34. The plasma display panel of claim 33, wherein a width of the first additional electrode is less than a width of the black matrix.

35. The plasma display panel of claim 28, wherein the first scan electrode includes a first bus electrode and the first sustain electrode includes a second bus electrode.

36. The plasma display panel of claim 35, wherein a width of the first additional electrode is different than a width of one of the first bus electrode and the second bus electrode.

37. The plasma display panel of claim 35, wherein a width of the first additional electrode is greater than a width of one of the first bus electrode and the second bus electrode.

38. The plasma display panel of claim 28, wherein the first additional electrode is formed of a single layer of silver (Ag).

39. The plasma display panel of claim 28, further comprising a second additional electrode over the first barrier rib.

* * * * *